United States Patent [19]

Hafner

[11] Patent Number: 4,536,730

[45] Date of Patent: Aug. 20, 1985

[54] DEFLECTION UNIT FOR PICTURE TUBES

[75] Inventor: Ulrich Hafner, Möckmühl, Fed. Rep. of Germany

[73] Assignee: International Standard Electric Corporation, New York, N.Y.

[21] Appl. No.: 580,455

[22] Filed: Feb. 15, 1984

[30] Foreign Application Priority Data

Feb. 24, 1983 [DE] Fed. Rep. of Germany ..... 3306385

[51] Int. Cl.[3] ..... H01F 5/00

[52] U.S. Cl. ..... 335/213; 313/426

[58] Field of Search ..... 335/210, 213; 313/421, 313/426

[56] References Cited

U.S. PATENT DOCUMENTS 4,128,824 12/1978 Mirsch ..... 335/210 X 4,228,413 10/1980 Campbell et al. ..... 335/210 X

*Primary Examiner*—George Harris

*Attorney, Agent, or Firm*—Donald J. Lenkszus

[57] ABSTRACT

On the deflection unit, the two windings as wound on to each toroidal core half, are subdivided into two winding halves which are each wound from the center of the toroidal core half toward the outside.

2 Claims, 2 Drawing Figures

DEFLECTION UNIT FOR PICTURE TUBES

The invention relates to a deflection unit for picture tubes, comprising a core of soft-magnetic material and at least two windings which, if necessary, consist of several layers, and in which, adjacent to an outer surface of the core, there are provided at least three projections for forming redirecting points for the winding wire, with one projection each being provided for at the ends, and one further projection in the center of each winding.

Such types of deflection units are known (DE-AS No. 28 42 528). Different kinds of deflection units are customarily used with picture tubes; on the one hand such ones in which the deflecting coils for the vertical (picture) deflection as well as those for the horizontal (line) deflection are wound on to toroidal cores. These deflection units are also referred to as toroid deflection units. Moreover, such deflection units are known in which the deflecting coils for the vertical (picture) deflection are designed as toroidal core windings and in which the deflecting coils for the horizontal (line) deflection consist of two saddle-shaped coils. Such deflection units are also referred to as semi-toroid deflection units.

The invention relates to deflecting coils designed as toroidal core windings. In a semi-toroid deflection unit, the vertical deflection field for the picture deflection is produced by a toroidal-core winding. The toroidal core itself consists of two symmetrical halves on each of which there is wound one winding which, if necessary, may consist of several layers. The toroidal core winding producing the vertical deflection field also serves to produce a keystone (trapezium) or barrel-shaped magnetic field pattern by which the distortion errors in the east-west direction as appearing in the course of deflecting the electron beams, can be compensated.

In the conventional deflection unit, the windings producing the vertical deflection field are in such a way wound on to the toroidal core halves, that the winding begins at the one end of the toroidal core half and is wound up to the other end of the toroidal core half. With the conventional windings the winding density may be inhomogeneous, but the winding wires always extend parallel in relation to the longitudinal axis of the picture tube. With such an arrangement of the windings, however, only such magnetic fields can be produced which have either a keystone- or a barrel-shaped field distortion.

For producing dynamic convergence in modern 110° colour picture tubes, however, there are required deflection units which, for compensating the distortion errors, produce magnetic fields which, at the rear end of the deflection unit facing the electron gun system, produce a strong barrel-shaped distortion and, at the front end of the deflection unit facing the viewing screen, show to have a weak barrel-shaped or keystone-shaped (trapezium) distortion of the magnetic field. Deflection units are already in use in which such a field pattern is produced in that the windings are arranged by extending slantingly on the toroidal core halves, that is, the winding wires extending in the direction of the longitudinal axis of the tube form an acute angle with the plane extending through the longitudinal axis of the tube. No matter whether the windings are wound on to the toroidal core halves in parallel or slantingly in relation to the longitudinal axis of the tube, it is in any case important with respect to the production of a good dynamic convergence and to a distortion freedom of the raster in a colour television tube, that the windings are quadrant-symmetrical, that is, that the windings arranged in the four quadrants of the toroidal core are designed to be symmetrical in relation to one another.

It is very difficult to obtain such a symmetry with the conventional types of deflection units in which the windings are wound continuously from the one end of the toroidal core half to the other, because the windings tend to displace themselves, especially in cases where the windings have a multi-layer design. This causes asymmetries of the produced fields to occur in the finished deflection unit, so that such deflection units become unsuitable for being used.

Attempts have already been made to avoid these disadvantages by attaching grooved bodies (e.g. of the type as known from DE-OS No. 26 03 464) to the edges of the toroidal core halves, in the grooves of which the windings or winding portions are compulsorily guided. Apart from the fact that these bodies involve an additional investment, they also prevent the windings of the deflection unit from being positioned as close as possible to the outer contour of the picture tube and, accordingly, to the electron beams. In the worst case, the absence of this property can lead to fade-out errors.

It is the object of the invention, therefore, to provide a deflection unit for picture tubes, comprising toroidal core windings wound on to the core, with which, also without requiring any coilformer-like aids for the windings, the required quadrant-symmetrical magnetic fields can be produced.

According to the invention, this object is achieved in that each winding consists of two winding halves which are symmetrical in relation to the plane lying in the longitudinal axis of the tube, of which each one is wound by starting out from the center of the winding, towards the sides.

Such a winding makes sure that the deflection unit in which it is contained, will produce the necessary symmetric magnetic fields. In the case of displacements of turns or winding parts happening in the course of producing the windings according to the invention, the effects are not so detrimental, because the windings are quadrant-symmetric and, consequently, the possible errors are likewise symmetric.

The proposed solution can still be improved in that the surface of the core is provided with a coating increasing the adhesion of the winding wire.

The invention will now be explained with reference to FIGS. 1 and 2 of the accompanying drawings, in which.

Figure 1:
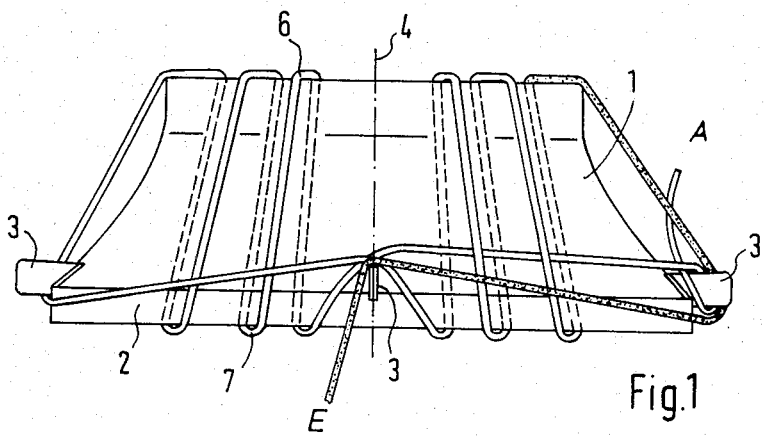
FIG. 1 is the sideview of a wound toroidal core.
Figure 2:
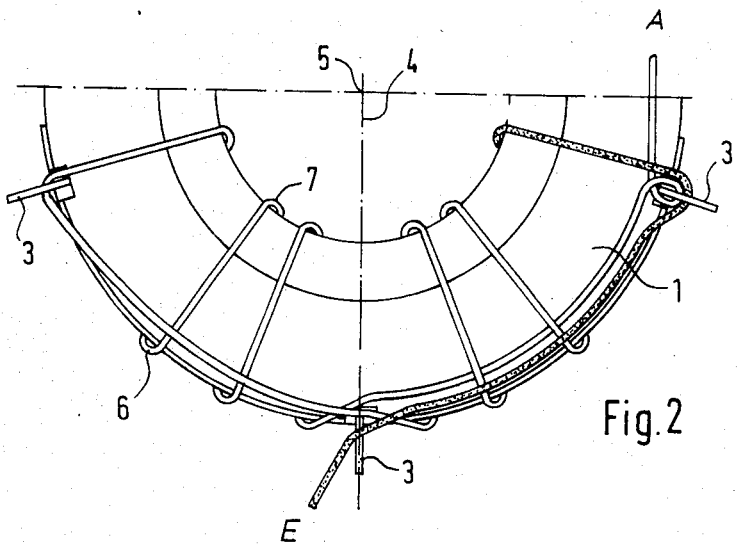
FIG. 2 shows one half of the wound toroidal core in a top view.

As can be seen from FIGS. 1 and 2, the toroidal core 1 is designed in the conventional way to consist of two parts, and to the edge of the toroidal core having the larger diameter, there is attached a strip 2 of nonmagnetizable material which is provided with the projections 3. The winding on each half of the toroidal core 1 is subdivided to two winding halves which are symmetrical in relation to a (imaginary) plane 4, extending through the longitudinal axis 5 of the picture tube. Since, in the given example of an embodiment, there is supposed to be concerned a helically wound winding, the individual turns, as can be seen from FIG. 1, form an acute angle with the plane 4, that is, the redirecting point 6 of the winding wire at the rear end of the deflection unit is closer to the plane 4 than the redirecting point 7 at the front end of the deflection unit.

The halves of a winding which are symmetrical in relation to one another and to the plane 4, are now wound in the following way, as can be recognized from FIGS. 1 and 2:

The beginning of the winding wire A is placed around the projection 3 at the right-hand end of the toroidal core half 1. Thereafter, the winding wire is led around the projection 3 in the center and around the left-hand winding half. At the winding end of the left-hand winding half, the winding wire is first led around the projection 3 at the left-hand end, and then around the projection 3 in the center of the toroidal core half 1, before the right-hand winding half is wound.

In this way, several layers can be wound on top of each other. In any case, however, the winding is effected from the center of the toroidal core half towards the ends of the toroidal core half.

I claim:

1. A deflection yoke comprising:

a toroidal core comprising two symmetrical halves of soft magnetic material, each core halve having at least three projections for forming redirecting points for a winding wound thereon;

a winding on each of said core halves;

each said winding comprising two winding halves, said two winding halves being arranged such that they do not overlap and are symetrically positioned relative to an imaginary plane which bisects both said core halves, said imaginary plane lying in the longitudinal axis of said toroidal core, said two winding halves being both wound from the center of the core half toward the respective ends of said core half.

2. A deflection yoke in accordance with claim 1 wherein:

said core includes a coating on the surface thereof to increase the adhesion of the winding wire.

* * * * *